US007126531B2

(12) United States Patent
Nakaya et al.

(10) Patent No.: US 7,126,531 B2
(45) Date of Patent: Oct. 24, 2006

(54) ARRAY ANTENNA SYSTEM AND WEIGHTING CONTROL TECHNIQUE USED IN ARRAY ANTENNA SYSTEM

(75) Inventors: Yuuta Nakaya, Kawasaki (JP); Takeshi Toda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 240 days.

(21) Appl. No.: 10/868,858

(22) Filed: Jun. 17, 2004

(65) Prior Publication Data

US 2005/0184906 A1 Aug. 25, 2005

(30) Foreign Application Priority Data

Feb. 24, 2004 (JP) ..... 2004-048126

(51) Int. Cl.
*H01Q 3/00* (2006.01)

(52) U.S. Cl. ..... 342/377

(58) Field of Classification Search ..... 342/377
See application file for complete search history.

(56) References Cited

U.S. PATENT DOCUMENTS

| | | | | |
|---|---|---|---|---|
| 2003/0109226 | A1* | 6/2003 | Brunner et al. | 455/69 |
| 2003/0125002 | A1* | 7/2003 | Harrison | 455/277.1 |
| 2003/0144032 | A1* | 7/2003 | Brunner et al. | 455/562 |
| 2004/0219899 | A1* | 11/2004 | Ho et al. | 455/273 |

OTHER PUBLICATIONS

L.C. Godara, Application of antenna arrays to mobile communications. II. Beam-forming and direction-of-arrival considerations, Proceedings of the IEEE, vol. 85(8), p. 1195-1245, Aug. 1997.*

D. Parker et al.; "Phased Arrays-Part I: Theory and Architectures"; *IEEE Transactions on Microwave Theory and Techniques*; vol. 50; No. 3; Mar. 2002; pp. 678-687./Discussed in the specification.

D. Parker et al.; "Phased Arrays-Part II: Implementations, Applications, and Future Trends"; *IEEE Transactions on Microwave Theory and Techinques*; vol. 50; No. 3; Mar. 2002; pp. 688-698./Discussed in the specification.

J.H. Winters; "Smart Antennas for Wireless Systems"; *IEEE Personal Communications*; Feb. 1998; pp. 23-27./Discussed in the specification.

* cited by examiner

*Primary Examiner*—Thomas H. Tarcza
*Assistant Examiner*—Fred H. Mull
(74) *Attorney, Agent, or Firm*—Armstrong, Kratz, Quintos, Hanson & Brooks, LLP

(57) ABSTRACT

An array antenna system comprises an array antenna unit including multiple antenna elements and multiple phase shifters for setting weighting coefficients of the associated antenna elements; and a weight controller that generates and outputs a control signal for adjusting the weighting coefficient for each of the antenna elements, using a known signal received at each of the antenna elements. The weight controller has a channel impulse response estimation unit that estimates a channel impulse response for each of the antenna elements based on a linear combination of a first received signal obtained from the known signal when a first set of weighting coefficients is set for the antenna elements and a second received signal obtained from the known signal when a second set of weighting coefficients is set for the antenna elements; and an output unit that outputs the control signal based on the estimated channel impulse responses.

14 Claims, 9 Drawing Sheets

ARRAY ANTENNA SYSTEM AND WEIGHTING CONTROL TECHNIQUE USED IN ARRAY ANTENNA SYSTEM

BACKGROUND OF THE INVENTION

The present invention generally relates to the technical field of wireless communication, and more particularly, to an antenna system using multiple antenna elements and a weighting control technique for such antenna systems.

Adaptive array antennas (AAAs), which are in the picture of the technological field of wireless communication, use multiple antenna elements for transmitting and receiving radio signals. According to the ever-changing communication environment, the amplitude and the phase of a signal input to and output from each of the antenna elements are appropriately adjusted. The input signals to or the output signals from the respective antenna elements are weighted and synthesized to improve the signal-to-interference-plus-noise ratio (SINR). The adaptive array antenna technique is advantageous from the viewpoints of improving communication quality, reducing interfering waves, expanding the communicating range, and dealing with multipath fading. With a digital scheme of the adaptive array antenna technique, a weighting coefficient given to each antenna element is defined in a digital format. Such an adaptive array antenna system is disclosed in, for example, "Smart Antennas for Wireless Systems," Jack H. Winters, IEEE Personal Communications, February 1998, pp. 23–27.

FIG. 1 illustrates a digital-based adaptive array antenna system. Each of N antenna elements 102 is furnished with an RF front end 104, an analog-to-digital converter 106, and a weighting unit 108. The weighting coefficients w1 through wN set at the respective weighting units 108 are determined by the weight controller 110.

With this arrangement, a digital signal is acquired separately from each of the antenna elements 102, and supplied to the weight controller 110. The weight controller 110 calculates the associated weighting coefficient accurately based on the digital signals. However, with this digital scheme, as many analog-to-digital converters 106 as the number of the antenna elements have to be prepared. This may be disadvantageous from the viewpoints of power saving and miniaturization of the system.

On the other hand, in some adaptive array antenna systems, weighting coefficients given to the antenna elements are analog-formatted. Such an analog-based adaptive array antenna system is disclosed in, for example, "Phased Arrays-Part I: Theory and Architectures", Don Parker and David C. Zimmermann, IEEE Transactions on Microwave Theory and Techniques, Vol. 50, No. 3, March 2002, pp. 678–687, and "Phased Arrays-Part II: Implementations, Applications, and Future Trends", Don Parker and David C. Zimmermann, IEEE Transactions on Microwave Theory and Techniques, Vol. 50, No. 3, March 2002, pp. 688–698.

With the analog scheme, the analog signal, which has been subjected to weighting and signal synthesis, is converted to a digital signal by the analog-to-digital converter 206 (FIG. 2). This arrangement is advantageous in power saving and size reduction. However, it takes time for this method to optimize all of N weighting coefficients w1 through wN. In addition, the weighting coefficient converges only to a local solution, without converging to the global optimum, due to less information being supplied to the weight controller 210. A global solution is the optimum weighting coefficient that is the maximum or the minimum in a given range of values. A local solution is the local optimum solution, which is the maximum or the minimum in a certain portion of the range, but is not necessarily the optimum in the entire range. It is desired to obtain the global optimum; however, with the conventional analog-based weighting control technique, the weighting coefficient may not converge to the global optimum, but only to the local solution, depending on how the initial value is set or on other conditions.

SUMMARY OF THE INVENTION

Therefore, it is an object of the invention to provide an array antenna system and a weighting control technique capable of obtaining the optimum weighting coefficient promptly.

In the basic research for the present invention, the inventors focused on and studied the relation between convergence of the solution in an analog-based adaptive antenna array and the channel impulse response (CIR) of each antenna element. In the conventional analog-based weighting control technique, channel impulse response and weighting coefficient are unknown, and therefore, it takes time to allow the weighting coefficient to converge appropriately. Under the condition where the CIR is unknown, it is difficult to define the direction of optimizing the weighting coefficient, and time and workload for the optimization increase. In contrast, if all the channel impulse responses are known, the optimum weighting coefficients can be determined by the minimum mean square error (MMSE) or other methods. To this end, the inventors have reached the conclusion that convergence of solution can be improved by determining the channel impulse response, and then determining the weighting coefficient based on the CIR.

In one aspect of the invention, an array antenna system comprises an array antenna unit including a plurality of antenna elements and a plurality of phase shifters, each phase shifter being provided to one of the antenna elements to set a weighting coefficient for the associated antenna element; and a weight controller configured to generate and output a control signal for adjusting the weighting coefficient for each of the antenna elements, using a known signal received at each of the antenna elements and subjected to weighting and signal synthesis. The weight controller includes (a) a channel impulse response estimation unit configured to estimate a channel impulse response for each of the antenna elements based on a linear combination of a first received signal obtained from the known signal when a first set of weighting coefficients is set for the antenna elements and a second received signal obtained from the known signal when a second set of weighting coefficients is set for the antenna elements; and (b) an output unit configured to output the control signal based on the estimated channel impulse response.

With this arrangement, an appropriate weighting is determined promptly for an array antenna.

In an example, the first set of weighting coefficients gives a same phase to all of the antenna elements, and the second set of weighting coefficients give a same phase to all of the antenna elements but for the target antenna element, while giving a different phase to the target antenna element.

In another example, the amplitude and the phase of each antenna element are adjusted by the control signal.

BRIEF DESCRIPTION OF THE DRAWINGS

Other objects, features, and advantages of the present invention will become more apparent from the following detailed description when read in conjunction with the accompanying drawings, in which.

DESCRIPTION OF THE PREFERRED EMBODIMENTS

The preferred embodiments of the invention are now described with reference to the accompanying drawings.

Figure 1:
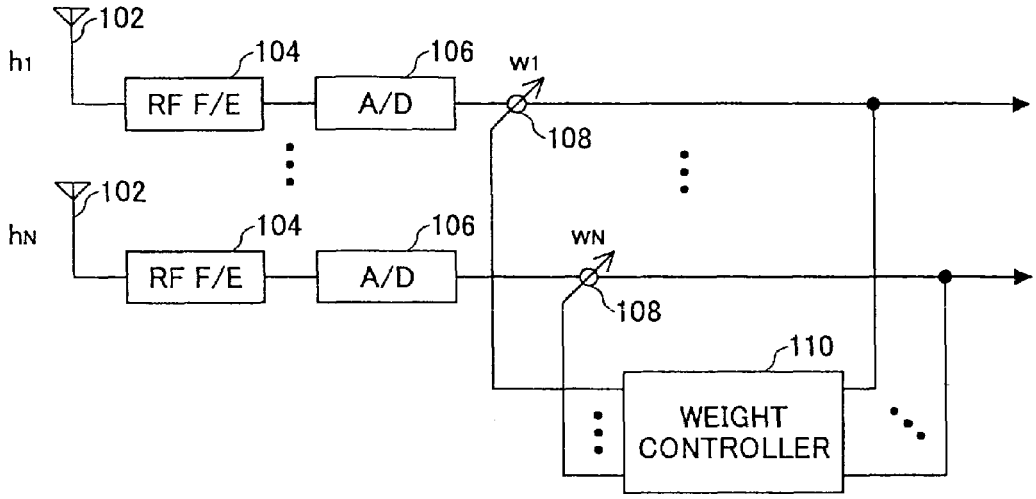
FIG.1 PRIOR ART
FIG. 1 illustrates the general structure of a digital-based adaptive array antenna system.
Figure 2:
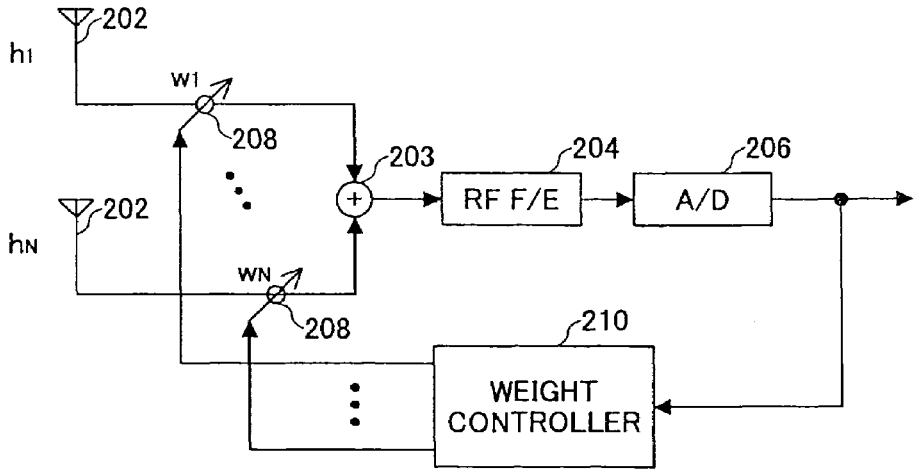
FIG.2 PRIOR ART
FIG. 2 illustrates the general structure of an analog-based adaptive array antenna system.
Figure 3:
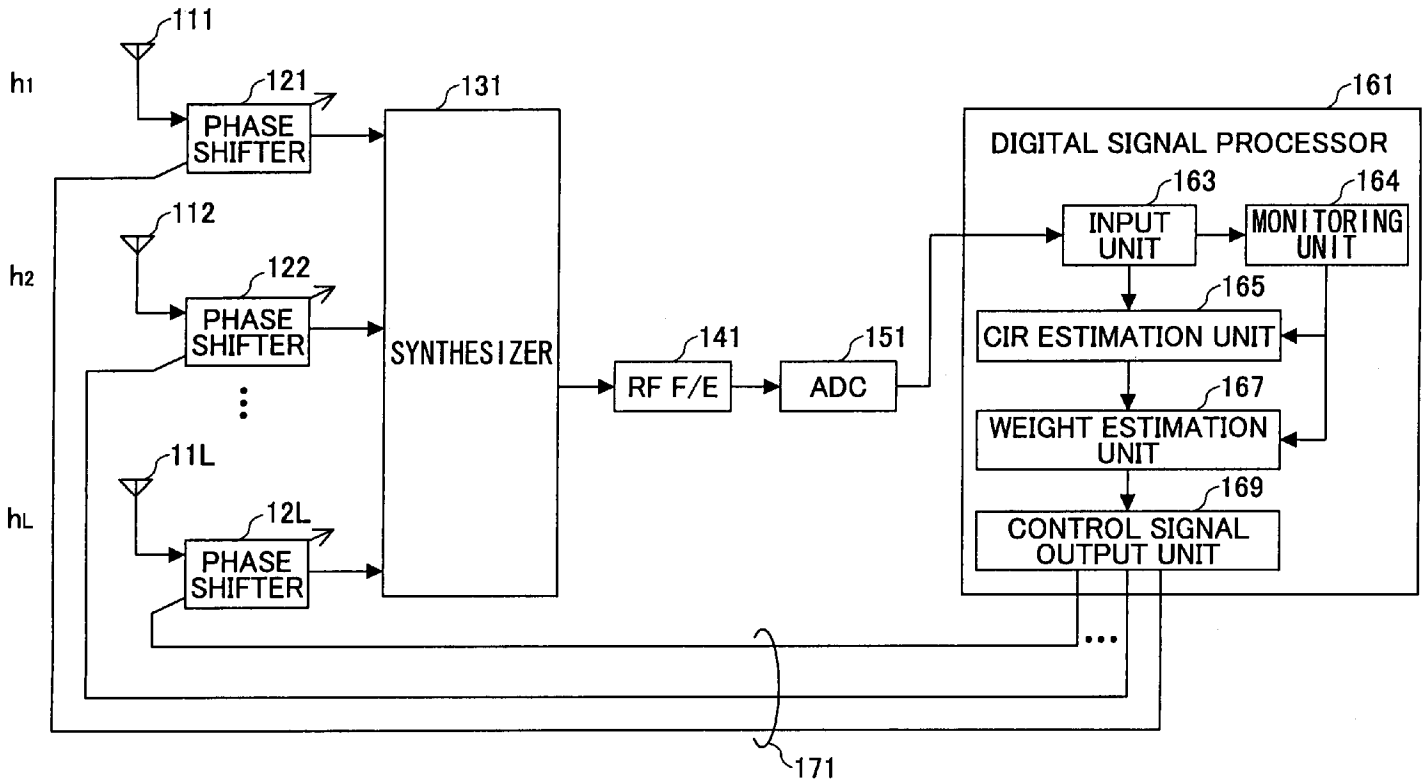
FIG. 3 is a block diagram of an adaptive array antenna system according to an embodiment of the invention.

FIG. 3 is a block diagram of an adaptive array antenna system according to an embodiment of the invention. Although the example shown in FIG. 3 is applied to a transmitter in order to facilitate explanation, this structure is similarly applicable to a receiver. The adaptive array antenna includes L antenna elements 111–11L, and L phase shifters 121–12L, each phase shifter being provided to one of the antenna elements. The adaptive array antenna also includes a synthesizer 131, an RF front end 141, an analog-to-digital converter 151, and a digital signal processor 161. To simplify the figure, those elements for demodulating received signals or generating transmission signals are omitted.

The digital signal processor 161 has an input unit 163, a monitoring unit 164, a channel impulse response (CIR) estimation unit 165, a weight estimation unit 167, and a control signal output unit 169. The digital signal processor 161 is connected to the phase shifters 121–12L through L control lines 171 to adjust the weighting coefficient (or the phase) set in the associated phase shifter. To this regard, the digital signal processor 161 functions as a weight controller.

Each of the phase shifters 121–12L sets a weighting coefficient, that is, a phase, for the signal received at the associated antenna element 11, based on the control signal supplied through the control line 171.

The synthesizer 131 synthesizes L signals that have been received at the antenna elements 111–11L and weighted by the phase shifters 121–12L, respectively. The RF front end 141 carries out signal processing, such as radio band conversion or band pass filtering, on the synthesized signal. The analog-to-digital converter 151 converts the analog signal output from the RF front end 141 into a digital signal.

The digital signal processor 161 generates a control signal based on the digital signal supplied from the analog-to-digital converter (ADC) 151, and outputs a control signal to each of the phase shifters 121–12L. The input unit 163 of the digital signal processor 161 receives and stores the digital signal. The monitoring unit 164 monitors change in the communication channel, and outputs an instruction according to the monitoring result. The CIR estimation unit 165 estimates a channel impulse response (CIR) for each of the antenna elements, based on digital signals (a first digital signal obtained when a first set of weighting coefficients is set in the phase shifters and a second digital signal obtained when a second set of weighting coefficients is set in the phase shifters) input to the input unit 163. The weight estimation unit 169 determines the optimum weighting coefficient (phase rotation in this example) for each antenna element based on the estimated CIR, using the MMSE method, for example. The control signal output unit 167 outputs a control signal for updating the weighting coefficient of each of the antenna elements to the estimated weighting coefficient. The control signal may be a digital signal, or alternatively, an analog signal, as long as it can cause the associated phase shifter 12 to set the weighting coefficient appropriately.

If the phase shifters 121–12L are digital phase shifters, which can take only discrete values (for example, only four values of 0 degrees, 90 degrees, 180 degrees, and 270 degrees), one of the values closest to the estimated weighting coefficient is set in the phase shifter. If the estimated weighting coefficient is 23.5 degrees when using a four-level digital phase shifter, the weighting coefficient of this phase shifter is set to 0 degrees.

Figure 4:
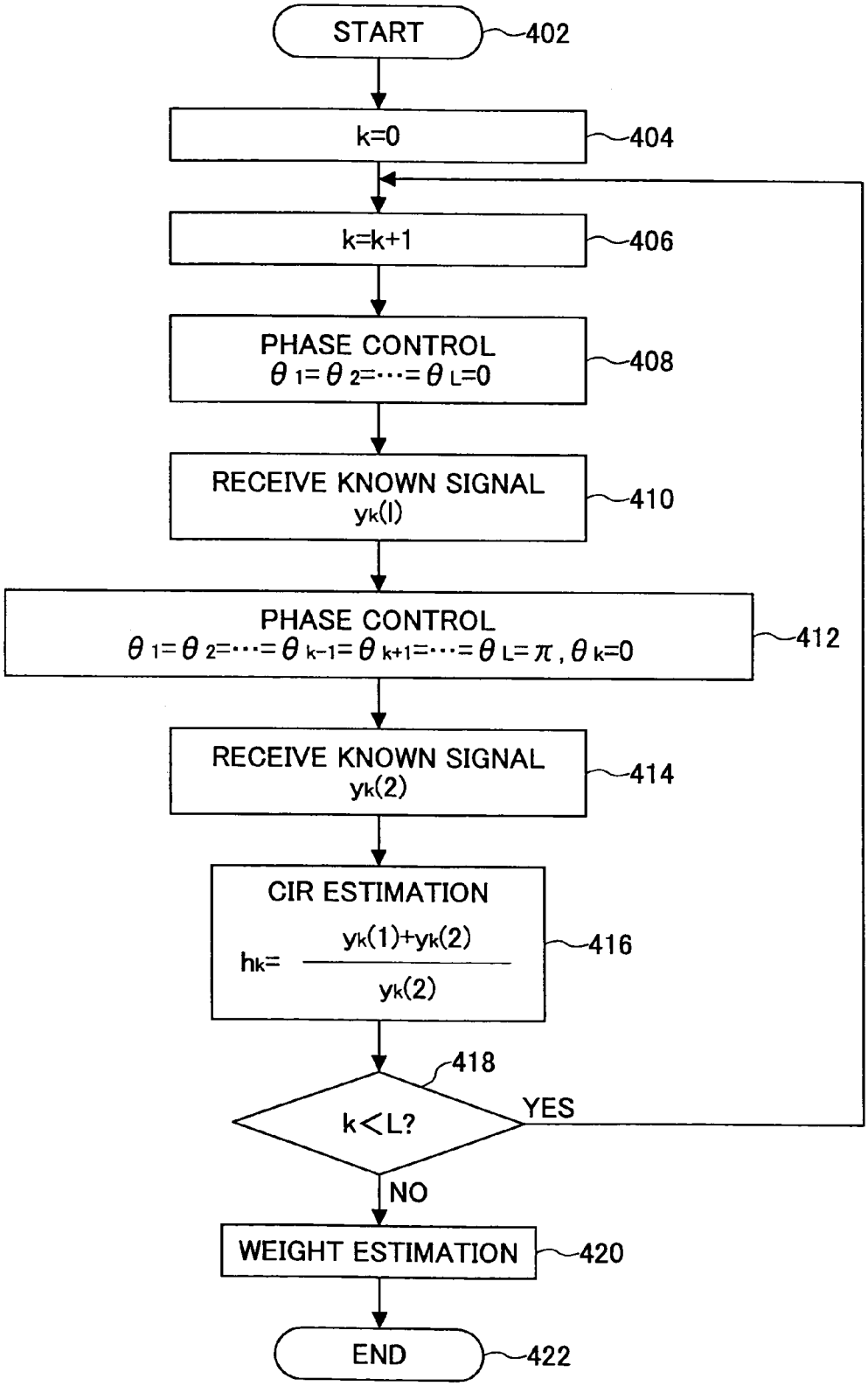
FIG. 4 is a flowchart showing the operation implemented in the adaptive array antenna system.

FIG. 4 is a flowchart showing the operation implemented by the adaptive array antenna system. In step S402, the process starts. In step S404, the parameter k for designating an antenna element among a plurality of antenna elements is initialized to zero. In this example, L antenna elements 111–11L are employed, and one of the antenna elements is designated by setting k to one of the values 1 to L.

In step S406, the parameter k is incremented to designate the next antenna element. Immediately after the initialization, the first antenna element is designated (k=1).

In step S408, a phase of 0 degrees is set as the weighting coefficient for all of the L antenna elements. Assuming that the phase given to the k-th antenna element is θk, the phases for the antenna elements are set in S408 such that $$\theta 1=\theta 2= \ldots =\theta k= \ldots =\theta L=0$$

The weighting coefficients (i.e., the phases) for the antenna elements 111–11L are set by the associated phase shifters 121–12L.

Figure 5:
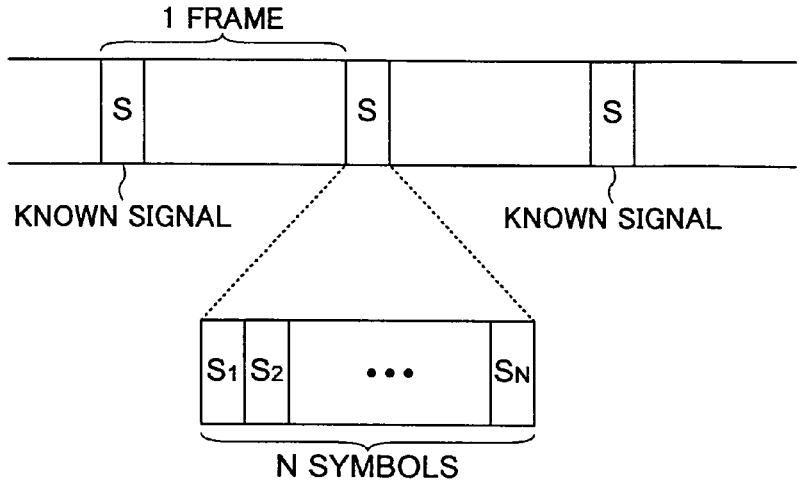
FIG. 5 illustrates a sequence of signals to be transmitted.

With the weighting coefficients appropriately set in the respective antenna elements, a known signal "s" is acquired at each of the antenna elements. A known signal is a signal known to both the transmitting end (not shown) and the receiving end, which may be referred to as a training signal, a preamble signal, or a pilot signal. Such a known signal component may be inserted in every transmission frame, as illustrated in FIG. 5. The interval or the frequency of insertion of the known signal may be or may not be constant. However, it should be noted that information about the timing of acquisition of the known signal has to be known at the transmitting end and the receiving end (especially at the receiving end). The known signal may be transmitted through a dedicated channel for channel estimation. Alternatively, the known signal may be transmitted through a channel other than the control channel (for payload). In this example, the known signal "s" is received at a constant time interval, as illustrated in FIG. 5.

In step S410, the known signal "s" is received at each of the antenna elements 111–11L. The received signals are weighted using the phase set in step S408, and synthesized at the synthesizer 131. The weighted and synthesized signal is supplied to the input unit 163 of the digital signal processor 161, via the RF front end 141 and the ADC 151, and it is saved as a non-inverted signal $y_k(1)$. The signal $y_k(1)$ is expressed as $$y_k(1) = \{h_1\exp(j\theta 1) + h_2\exp(j\theta 2) + \ldots + h_k\exp(j\theta k) + \ldots + h_L\exp(j\theta L)\} * s = (h_1 + h_2 + \ldots + h_k + \ldots + h_L) * s. \quad (1)$$

In step S412, while the weighting coefficient of the k-th antenna element (currently processed antenna element) is set to 0 degrees, a phase of 180 degrees (π radians) is set for the other (L−1) antenna elements (except for the k-th antenna element). In other words, the phases for the antenna elements are set as $$\theta 1=\theta 2= \ldots =\theta k-1= \ldots =\theta L=\pi, \text{ and}$$

$$\theta k=0.$$

In step S414, the next-arriving known signal "s" is received at each of the antenna elements 111–11L. The received known signals are weighted using the phase set in step S412, and synthesized at the synthesizer 131. The weighted and synthesized signal is supplied to the input unit 163 of the digital signal processor 161, via the RF front end 141 and the ADC 151, and it is saved as an inverted signal $y_k(2)$. The second-arriving signal $y_k(2)$ is expressed as $$y_k(2) = \{h_1\exp(j\theta 1) + h_2\exp(j\theta 2) + \ldots + h_k\exp(j\theta k) + \ldots + h_L\exp(j\theta L)\}s = (-h_1 - h_2 - \ldots - h_{k-1} + h_k - h_{k+1} - \ldots h_L) * s. \quad (2)$$

In step S416, the channel impulse response $h_k$ for the k-th antenna element is estimated at the CIR estimation unit 165 using equation 3.

$$h_k=(yk(1)+yk(2))/2s \quad (3)$$

In step S418, it is determined whether k is smaller than L (k<L). If k<L (YES in S418), the channel impulse responses for all the antenna elements have not been obtained yet, and therefore, the process returns to step S406 to increment the k value. The steps S406 through S418 are repeated for the (k+1)th antenna element to estimate the channel impulse response for this antenna element. If k is not smaller than L (NO in S418), channel impulse responses $h_k$ have been obtained for all the antenna elements. In this case, the process proceeds to step S420.

In step S420, the optimum weighting coefficients (phases to be set in the phase shifters 121–12L) are estimated by the weight estimation unit 167, based on the L channel impulse responses $h_1$ through $h_L$. The weighting coefficient set can be estimated by the MMSE method or other suitable methods. The weight estimation unit 167 supplies the data about the estimated set of weighting coefficients to the control signal output unit 169. The control signal output unit 169 generates a set of control signals for updating the weighting coefficients to the estimated values, and supplies these control signals to the associated phase shifters 121–12L via the control lines 171. In this manner, the optimum phase can be set for each of the antenna elements 111–11L. In step S422, the operation flow terminates.

In general, the known signal "s" consists of a plurality of symbols ($s_1$, $s_2$, . . . , $s_N$, for example), as illustrated in FIG. 5. Accordingly, the channel impulse response $h_k$ for the k-th antenna element is calculated for each of the symbols $s_1$ through $s_N$, and N channel impulse responses $h_{k1}$, $h_{k2}$, . . . , $h_{kN}$ are estimated for the k-th antenna element, as expressed by $$h_{k1} = (yk(1) + yk(2))/2s_1$$
$$h_{k2} = (yk(1) + yk(2))/2s_2$$
$$\ldots$$
$$h_{kN} = (yk(1) + yk(2))/2s_N. \quad (4)$$

In this case, it is desired to take an average of the instantaneous channel impulse responses $h_{k1}$ through $h_{kN}$ of all the symbols, as expressed by $$h_k=(h_{k1}+h_{k2}+ \ldots +h_{kN})/N. \quad (5)$$

The phase set in step S408 or S412 is not limited to the above-described example. For instance, in step S412, the phase of the k-th antenna element may be set to π, and the other phases may be set to zero. In this case, a channel impulse response $h_k$ is calculated using equation (6).

$$h_k=(yk(1)-yk(2))/2s \quad (6)$$

This arrangement is advantageous because the number of weighting coefficients to be changed in step S412 is small. To be more precise, with the latter arrangement, only θk is changed from 0 to π. In contrast, in the arrangement shown in the flowchart of FIG. 4, all the weighting coefficients, but for θk, have to be changed from 0 to π.

The phase to be set in the phase shifter is not limited to 0 and π radians. For example, in step S408, the phases for the antenna elements may be set as $$\theta 1=\theta 2= \ldots =\theta k= \ldots =\theta L=\pi/2.$$

Similarly, in step S412, the phases may be set as $$\theta 1=\theta 2= \ldots =\theta k-1=\theta k+1= \ldots =\theta L=\pi/2, \text{ and}$$

$$\theta k=-\pi/2(=3\pi/2).$$

In this case, the channel impulse response estimated in step S416 is expressed by equation (7).

$$h_k=(yk(1)-yk(2))/2j \quad (7)$$

In more general terms, the phase controlled in step S408 may be set to an arbitrary value $\theta_\alpha$, and the phase for the k-th antenna element may be solely set to $-\theta_\alpha$ in step S412. In this case, the channel impulse response estimated in step S416 is expressed by equation (8).

$$h_k=(yk(1)-yk(2))/(2j*\sin\theta_\alpha) \quad (8)$$

In addition, L sets of weighting coefficients {θ1, . . . , θL} may be prepared to solve simultaneous equations for channel impulse responses $h_1$, . . . , $h_L$. In this case, the first set of weighting coefficients is set in the phase shifters to weight the known signals, and a first synthesized signal y(1) is acquired. Then, the second set of weighting coefficients is set in the phase shifters to acquire a second synthesized signal y(2). In this manner, L signals y(1) through y(L) are successively acquired by updating the weighting coefficient set. Based on the L formulae with respect to the channel impulse response, L channel impulse responses $h_1$ through $h_L$ can be determined. From the viewpoint of reducing the computational workload, it is preferable to set the phase (the weighting coefficient) to an integral multiple of $\pi/2$, and more preferably, to zero or $\pi$ radians.

The channel impulse response does not greatly change in the indoor communication environment. However, it varies greatly when communicating with a mobile terminal that is traveling at high speed. Accordingly, the operation flow shown in FIG. 4 may be executed only when the channel impulse response is easy to change; otherwise, weighting control may be carried out based on fixed values of channel impulse responses for control efficiency. To implement this, a monitoring unit 164 is provided in the digital signal processor 161, inside or outside the input unit 163. In the example shown in FIG. 3, the monitoring unit 154 is arranged outside the input unit 163 to monitor the communication channel condition.

The monitoring unit 164 estimates the quantity representing variation in the channel environment. When the monitored quantity exceeds the threshold, the monitoring unit 164 outputs an instruction signal to the CIR estimation unit 165 and the weight estimation unit 167 to start the algorithm shown in FIG. 4 in order to update the channel impulse response. The quantity representing the variation in channel environment is, for example, a product of the Doppler frequency fd and time interval Ts of the known signal "s". In this case, if the product fd*Ts is smaller than 1 (fd*Ts<1), then variation in the channel is small. If the product fd*Ts is greater than or equal to 1 (fd*Ts≧1), the variation in the channel is large.

Figure 6:
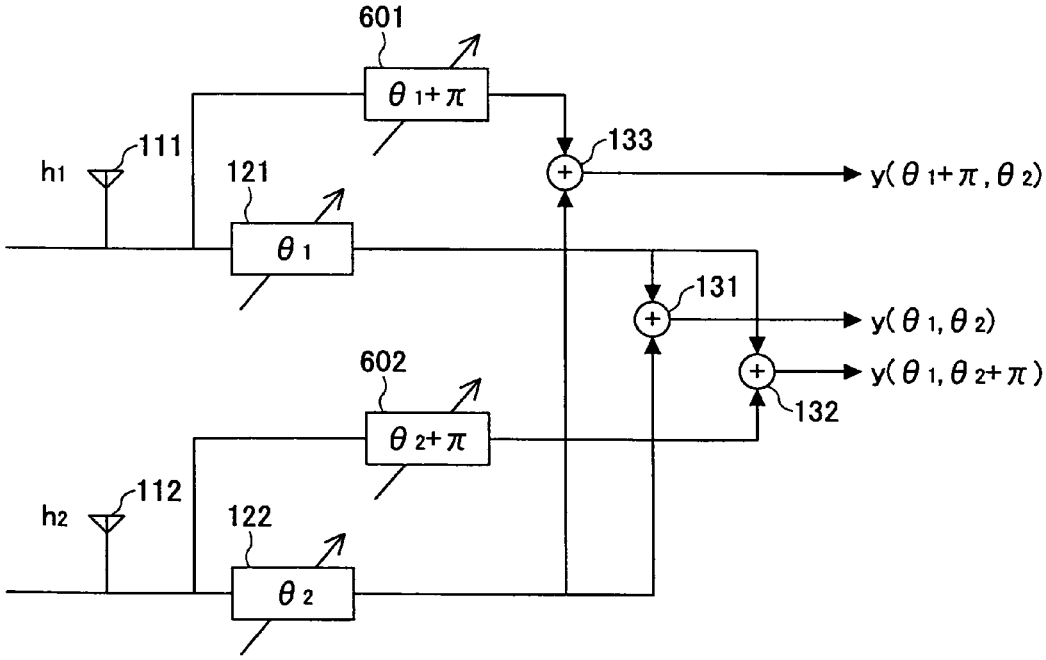
FIG. 6 illustrates a modification of the adaptive array antenna, which can determine the CIR by receiving a known signal only once.

FIG. 6 illustrates a modification of the adaptive array antenna of the above-described embodiment. In the example described with reference to FIG. 4, the same known signal "s" is received twice, at different times, to estimate the channel impulse response for each of the antenna element. In the modification shown in FIG. 6, the circuit is modified so as to allow the system to receive the known signal "s" only once. Although in FIG. 6 only two circuit for two antenna elements are illustrated for simplification of the figure, this arrangement can also be applicable to three or more antenna elements.

An additional phase shifter 601 is provided to the first antenna element 111, together with the phase shifter 121. Similarly, an additional phase shifter 602 is provided to the second antenna element 112, together with the phase shifter 122. The phase shifter 601 gives a phase angle $-\theta 1$ with an opposite sign of the phase angle $\theta 1$ given by the phase shifter 121. The phase shifter 602 gives a phase angle $-\theta 2$ with an opposite sign of the phase angle $\theta 2$ given by the phase shifter 122. The outputs from the phase shifters 121 and 122 are synthesized at the synthesizer 131, and an output signal $y(\theta 1, \theta 2)$ is obtained. The outputs from the phase shifters 601 and 122 are synthesized at the synthesizer 133, and an output signal $y(-\theta 1, \theta 2)$ is obtained. The outputs from the phase shifters 121 and 602 are synthesized at the synthesizer 132, and an output signal $y(\theta 1, -\theta 2)$ is obtained. The channel impulse responses h1 and h2 for the first and the second antenna elements are expressed as $$h_1=(y(\theta 1, \theta 2)+y(\theta 1+\pi, \theta 2))/2\exp(j\theta 1)$$

$$h_2=(y(\theta 1, \theta 2)-y(\theta 1, \theta 2+\pi))/-2\exp(j\theta 2). \quad (9)$$

With this arrangement, the system does not have to receive the known signal twice; however, additional phase shifters and synthesizers are required.

Figure 7:
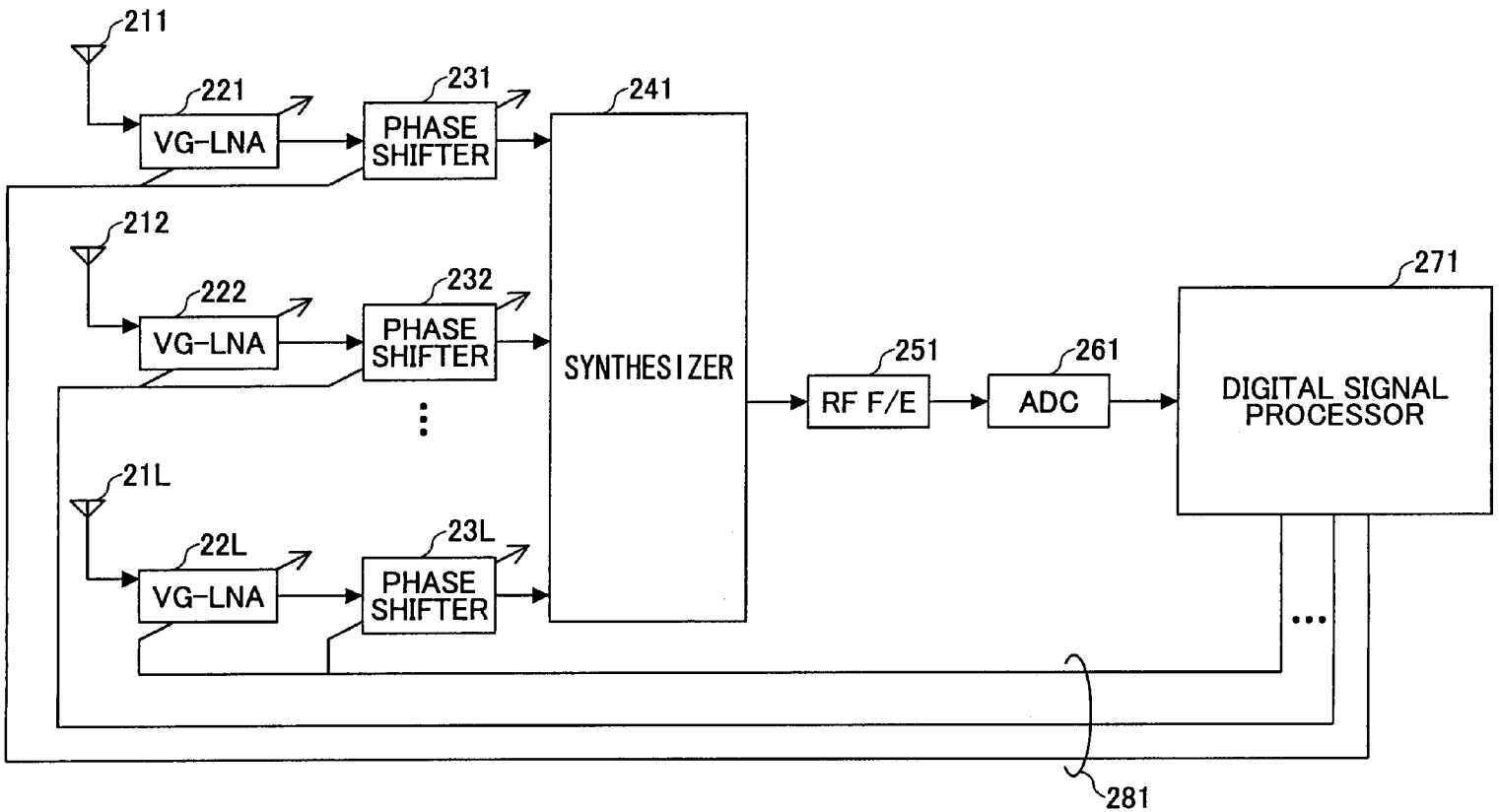
FIG. 7 is a block diagram of an adaptive array antenna system according to the second embodiment of the invention.

FIG. 7 is a block diagram of an adaptive array antenna system according to the second embodiment of the invention. The adaptive array antenna system includes L antenna elements 211–21L, L variable gain-low noise amplifiers (VG-LNA) 221–22L, and L phase shifters 231–23L. The adaptive array antenna system also includes a synthesizer 241, an RF front end 251, an analog-to-digital converter 261, and a digital signal processor 271. The VG-LANs 221–221 and the phase shifters 231–23L are connected to the digital signal processor 271 via corresponding L control lines 281.

Each of the VG-LNAs 221–22L sets the amplitude of the signal received at the associated antenna element, based on the control signal supplied through the control line 281. Each of the phase shifters 231–23L sets the phase of the signal received at the associated antenna element, based on the control signal supplied through the control line 281. The synthesizer 241 synthesizes the L signals weighted by the respective phase shifters 231–23L. The RF front end 251 carries out signal processing, such as radio band conversion or band pass filtering, on the synthesized signal. The analog-to-digital converter 261 converts the analog signal output from the RF front end 251 into a digital signal.

The digital signal processor 271 generates a control signal based on the digital signal supplied from the analog-to-digital converter (ADC) 261, and outputs the control signal to each of the phase shifters 231–23L and each of the VG-LNAs 221–22L. The control signal used in this embodiment adjusts not only the phase, but also the amplitude of the received signal. The operation of the digital signal processor 271 is the same as that explained in the previous embodiment, and explanation for it is omitted.

In this embodiment, the amplitude and the phase of the received signal are adjusted for each antenna element. By setting the gain of an antenna element that receives a signal at a high quality greater than the gains of the other antenna elements, the quality of the synthesized and digitalized signal to be supplied to the digital signal processor can be improved. In addition, the estimated weighting coefficient becomes more accurate. In addition, the gain of the currently processed antenna element (associated with the parameter k) may be set greater than the gains of the other antenna elements. In this case, the estimation accuracies of the channel impulse response hk and the weighting coefficient can also be improved.

Figure 8:
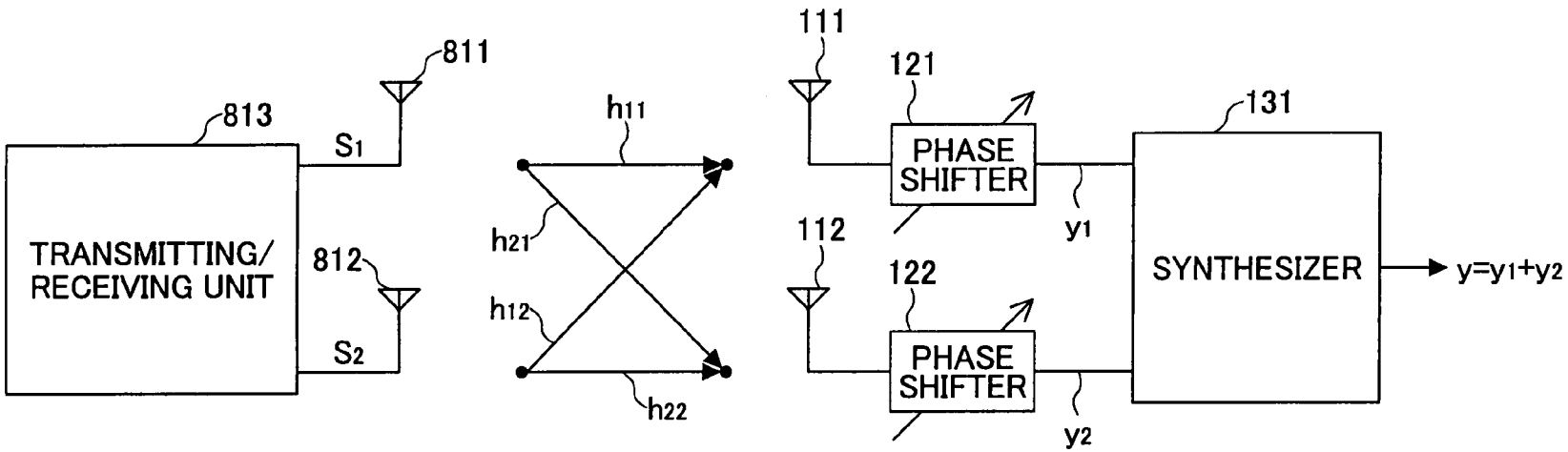
FIG. 8 is a block diagram of an adaptive array antenna system according to the third embodiment of the invention.

FIG. 8 is a block diagram of an adaptive array antenna system according to the third embodiment of the invention. In the first and second embodiments, it is assumed that the known signal "s" is transmitted from a single antenna element, and is received at multiple antenna elements. However, the present invention is not limited to such applications. Multiple known signals may be transmitted separately from multiple antenna elements, and be received at multiple antenna elements.

In the example shown in FIG. 8, two different known signals s1 and s2 are transmitted from two antenna elements 811 and 182 of the transmitting and receiving unit 813 for the purpose of simplifying explanation. Each of the two antenna elements 111 and 112 of the receiving end receives the known signals s1 and s2 through different channels. The transmission-side antenna elements 811 and 812 may or may not form an adaptive array antenna; however, it is necessary for the known signals s1 and s2 to be orthogonal to each other. In other words, the known signals s1 and s2 are defined such that equation 10 holds.

$$E[si \cdot sj]=\delta ij(i, j=1, 2) \quad (10)$$

where E denotes the expected value, and δij is the Kronecker delta that returns 1 if arguments are equal (i=j) and 0 otherwise. There are four channels impulse responses $h_{11}$, $h_{12}$, $h_{21}$, and $h_{22}$ between the transmission-side antenna elements 811 and 812 and the receiving-side antenna elements 111 and 112. The channel impulse response between the i-th receiving-end antenna element and the j-th transmission-end antenna element is generalized as hij.

The signal y output from the synthesizer 131 is the sum of y1 and y2, which have been received at the respective antenna elements 111 and 112 and weighted by the respective phase shifters 121 and 122. In this case, the synthesized signal y is expressed as $$\begin{aligned} y &= y1 + y2 \\ &= (h_{11} * s1 + h_{12} * s2)\exp(j\theta 1) + (h_{21} * s1 + h_{22} * s2)\exp(j\theta 2) \\ &= [h_{11}\exp(j\theta 1) + h_{21}\exp(j\theta 2)] * s1 + \\ &\quad [h_{12}\exp(j\theta 1) + h_{22}\exp(j\theta 2)] * s2 \end{aligned} \tag{11}$$

where θ1 is the weighting coefficient (or the phase) given by the phase shifter 121, and θ2 is the weighting coefficient given by the phase shifter 122. Taking into account the orthogonality of the known signals s1 and s2, the following relation holds.

$$E[s1 \cdot y] = h_{11}\exp(j\theta 1) + h_{21}\exp(j\theta 2) \tag{12}$$

Accordingly, channel impulse responses $h_{11}$ and $h_{21}$ are obtained by $$\begin{aligned} h_{11} &= (1/2)*[E[s1 \cdot y]|_{\theta 1=\theta 2=0} + [E[s1 \cdot y]|_{\theta 1=0,\ \theta 2=\pi}]. \\ h_{21} &= (1/2)*[E[s1 \cdot y]|_{\theta 1=\theta 2=0} - [E[s1 \cdot y]|_{\theta 1=0,\ \theta 2=\pi}]. \end{aligned} \tag{13}$$

Similarly, channel impulse responses $h_{12}$ and $h_{22}$ are obtained by $$\begin{aligned} h_{12} &= (1/2)*[E[s2 \cdot y]|_{\theta 1=\theta 2=0} + [E[s2 \cdot y]|_{\theta 1=0,\ \theta 2=\pi}] \\ h_{22} &= (1/2)*[E[s2 \cdot y]|_{\theta 1=\theta 2=0} - [E[s2 \cdot y]|_{\theta 1=0,\ \theta 2=\pi}]. \end{aligned} \tag{14}$$

In this manner, channel impulse responses $h_{11}$, $h_{12}$, $h_{21}$, and $h_{22}$ are estimated according to the operation flow shown in FIG. 4, and based on the estimated channel impulse responses, weighting coefficients are estimated.

Figure 9:
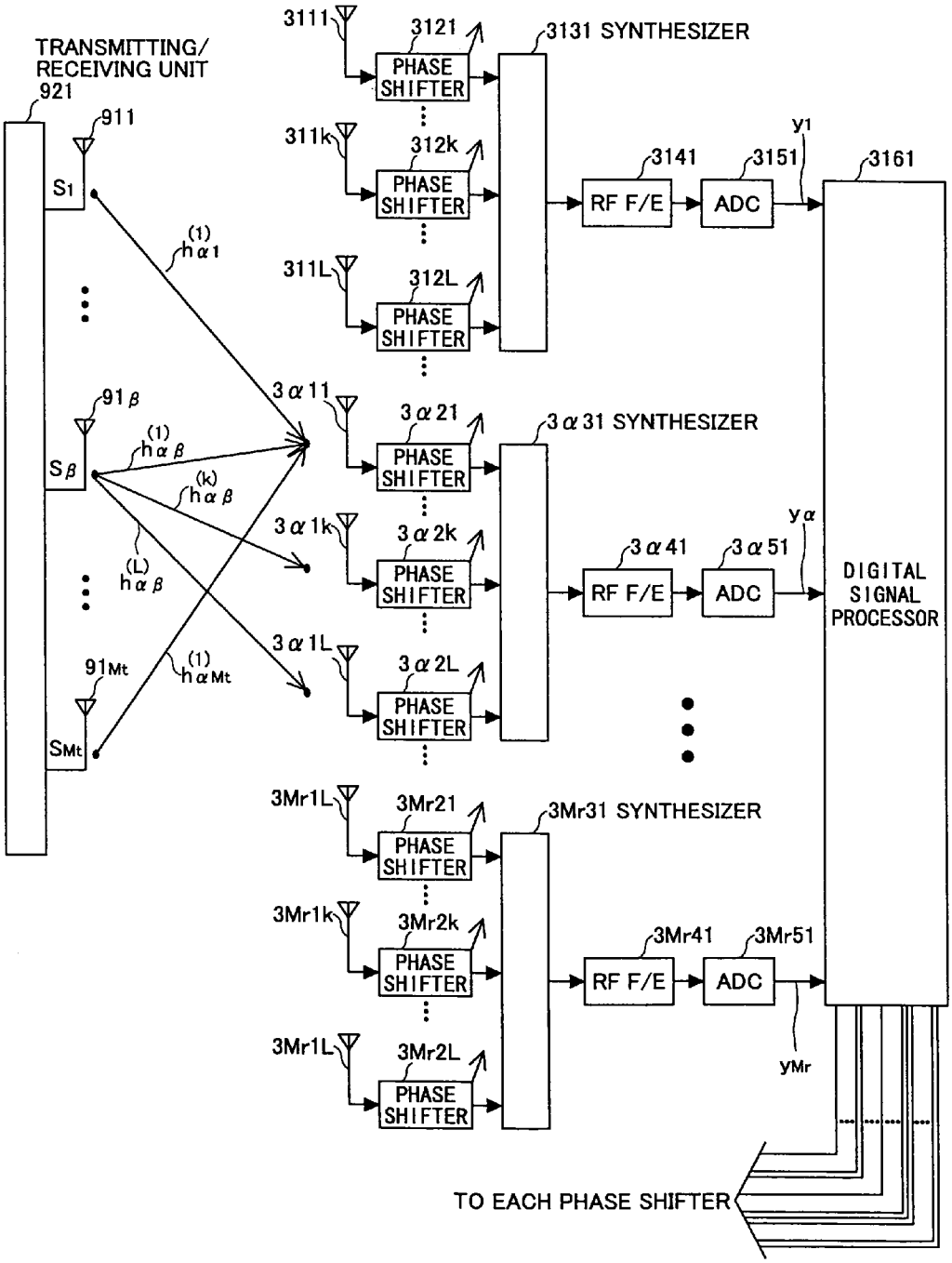
FIG. 9 is a block diagram of an adaptive array antenna system according to the fourth embodiment of the invention.
Figure 10:
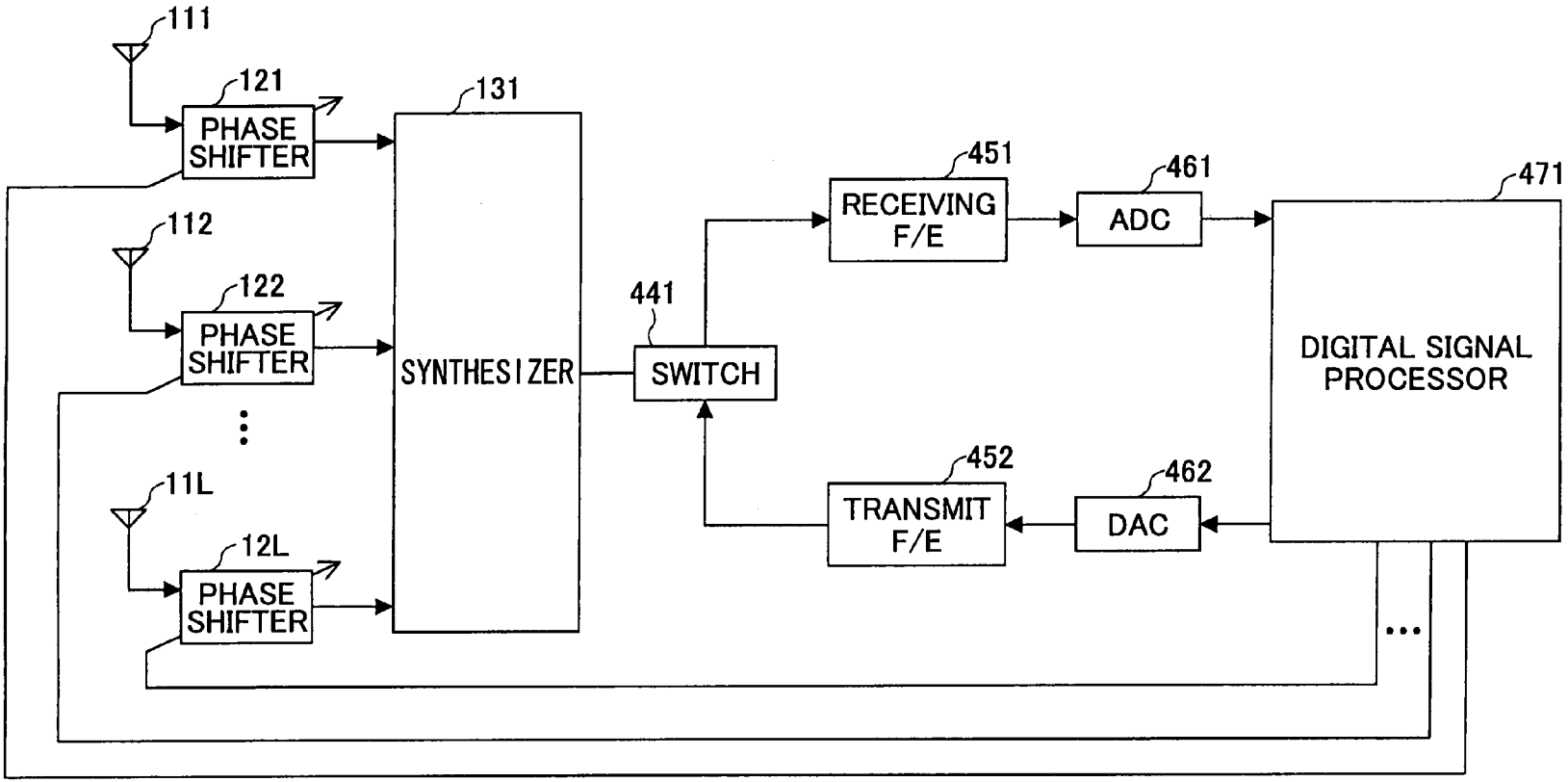
FIG. 10 is a block diagram of an adaptive array antenna system according to the fifth embodiment of the invention.

FIG. 9 is a block diagram of an adaptive array antenna system according to the fourth embodiment of the invention. In this embodiment, the adaptive array antenna system is applied to a multi-input-multi-output (MIMO) receiver. The receiver has multiple branches (the number of branches is, for example, Mr), each branch being provided with an adaptive array antenna having L antenna elements and L phase shifters, as in the previous embodiments. In the first branch, the signals received at L antenna elements 3111–311L are weighted by the associated phase shifters 3121–312L, synthesized by the synthesizer 3131, processed by the RF front end 3141, and digitized by the ADC 3151. The same applies to the other branches. Accordingly, the adaptive array antenna system includes synthesizers 3131–3Mr31, RF front ends 3141–3Mr41, and ADCs 3151–3Mr51. As many digital signals $y_1$, $y_2$, . . . , $y_\alpha$, . . . , $y_{Mr}$ as the number of the branches are input to the digital signal processor 3161. The digital signal processor 3161 estimates a set of channel impulse responses corresponding to the respective antenna elements of each branch. Based on the estimated channel impulse responses, a set of weighting coefficients is estimated and control signals are output for each branch.

In the example shown in FIG. 9, multiple known signals $s_1$, . . . , $s_\beta$, . . . , $s_{Mt}$ (the number of known signals is Mt) are transmitted from the respective antenna elements 911, . . . , 91β, . . . , 91Mt of the transmitting end, and received at Mr×L antenna elements of the receiving end. The known signals $s_i$ are orthogonal to each other. This is expressed as $$E[si \cdot sj] = \delta ij(i, j=1, \ldots, \beta, \ldots, Mt). \tag{15}$$

The received signal vector y is defined as y=Hs, where H is the channel impulse response matrix consisting of entries $h_{\alpha\beta}$, and s is the known signal vector.

$$\begin{bmatrix} y_1 \\ y_2 \\ \vdots \\ y_{M_r} \end{bmatrix} = \begin{bmatrix} h_{11} & h_{12} & \cdots & h_{1M_t} \\ h_{21} & h_{12} & \cdots & h_{1M_t} \\ \vdots & \vdots & \ddots & \vdots \\ h_{M_r1} & h_{M_r1} & \cdots & h_{M_rM_t} \end{bmatrix} \begin{bmatrix} S_1 \\ S_2 \\ \vdots \\ S_{M_t} \end{bmatrix} \tag{16}$$

$$h_{\alpha\beta} = \sum_{k=1}^{L} h_{\alpha\beta}^{(k)} e^{j\theta_\alpha^{(k)}} (\alpha = 1, 2, \ldots, M_r, \beta = 1, 2 \ldots, M_t)$$

Focusing on the signal $y_\alpha$ received at the α-th branch, it is expressed as $$\begin{aligned} y_\alpha = {} & [h_{\alpha 1}^{(1)}\exp(j\theta_\alpha^{(1)}) + \ldots + h_{\alpha 1}^{(k)}\exp(j\theta_\alpha^{(k)}) + \ldots + h_{\alpha 1}^{(L)}\exp(j\theta_\alpha^{(L)})] * s_1 + \\ & \ldots + [h_{\alpha\beta}^{(1)}\exp(j\theta_\alpha^{(1)}) + \ldots + h_{\alpha\beta}^{(k)}\exp(j\theta_\alpha^{(k)}) + \ldots + h_{\alpha\beta}^{(L)}\exp(j\theta_\alpha^{(L)})] * \\ & s_\beta + \ldots + [h_{\alpha Mt}^{(1)}\exp(j\theta_\alpha^{(1)}) + \ldots + \\ & h_{\alpha Mt}^{(k)}\exp(j\theta_\alpha^{(k)}) + \ldots + h_{\alpha Mt}^{(L)}\exp(j\theta_\alpha^{(L)})] * s_{Mt} \end{aligned} \tag{17}$$

where $h_{\alpha\beta}^{(k)}$ denotes the channel impulse response between the k-th antenna element of the α-th branch of the receiving end and the β-th antenna element of the transmission end. Taking the orthogonality of the known signals $s_i$ into account, equation 18 holds.

$$E[s_\beta y_\alpha] = h_{\alpha\beta}^{(1)}\exp(j\theta_\alpha^{(1)}) + \ldots + h_{\alpha\beta}^{(k)}\exp(j\theta_\alpha^{(k)}) + \ldots + h_{\alpha\beta}^{(L)}\exp(j\theta_\alpha^{(L)}) \tag{18}$$

Accordingly, the first signal $h_{\alpha\beta}^{(k)}$, which is acquired when setting the phases of all the antenna elements of the α-th branch to zero ($\theta_\alpha^{(1)} = \ldots = \theta_\alpha^{(L)} = 0$), and the second signal $E_2[s_\beta y_\alpha]$, which is acquired when setting the phases of all the antenna elements but for k-th element to π, while setting the phase of the k-th antenna element to zero ($\theta_\alpha^{(k)} = 0$, $\theta_\alpha^{(1)} = \ldots = {}_\alpha^{(k-1)} = \theta_\alpha^{(k+1)} = \ldots = \theta_\alpha^{(L)} = \pi$), are added and divided by two to estimate the channel impulse response=$h_{\alpha\beta}^{(k)}$.

$$h_{\alpha\beta}^{(k)} = (E_1[s_\beta y_\alpha] + E_2 s_\beta y_\alpha])/2 \tag{19}$$

In this manner, the channel impulse response and the weighting coefficient for each antenna element of each branch can be estimated according to the operation flow shown in FIG. 4.

FIG, 10 is a block diagram of an adaptive array antenna system according to the fifth embodiment of the invention, which is applied to the time division duplex (TDD) scheme.

The adaptive array antenna system includes L antenna elements 111–11L, L phase shifters 121–12L, and a switch 441 for switching between a received signal processing line and a transmitted signal processing line, both lines being connected to a digital signal processor 471. The received signal processing line includes a receiving front end 451 and an analog-to-digital converter (ADC) 461. The transmitted signal processing line includes a transmission front end 452 and a digital-to-analog converter (DAC) 462.

In the TDD scheme, the same frequency is used in transmitting and receiving signals. Accordingly, the optimum weighting coefficient set for receiving a signal can be used when transmitting a signal. Since weighting control is carried out in common between transmitting and receiving signals, the adaptive array antenna system can be made compact.

Figure 11:
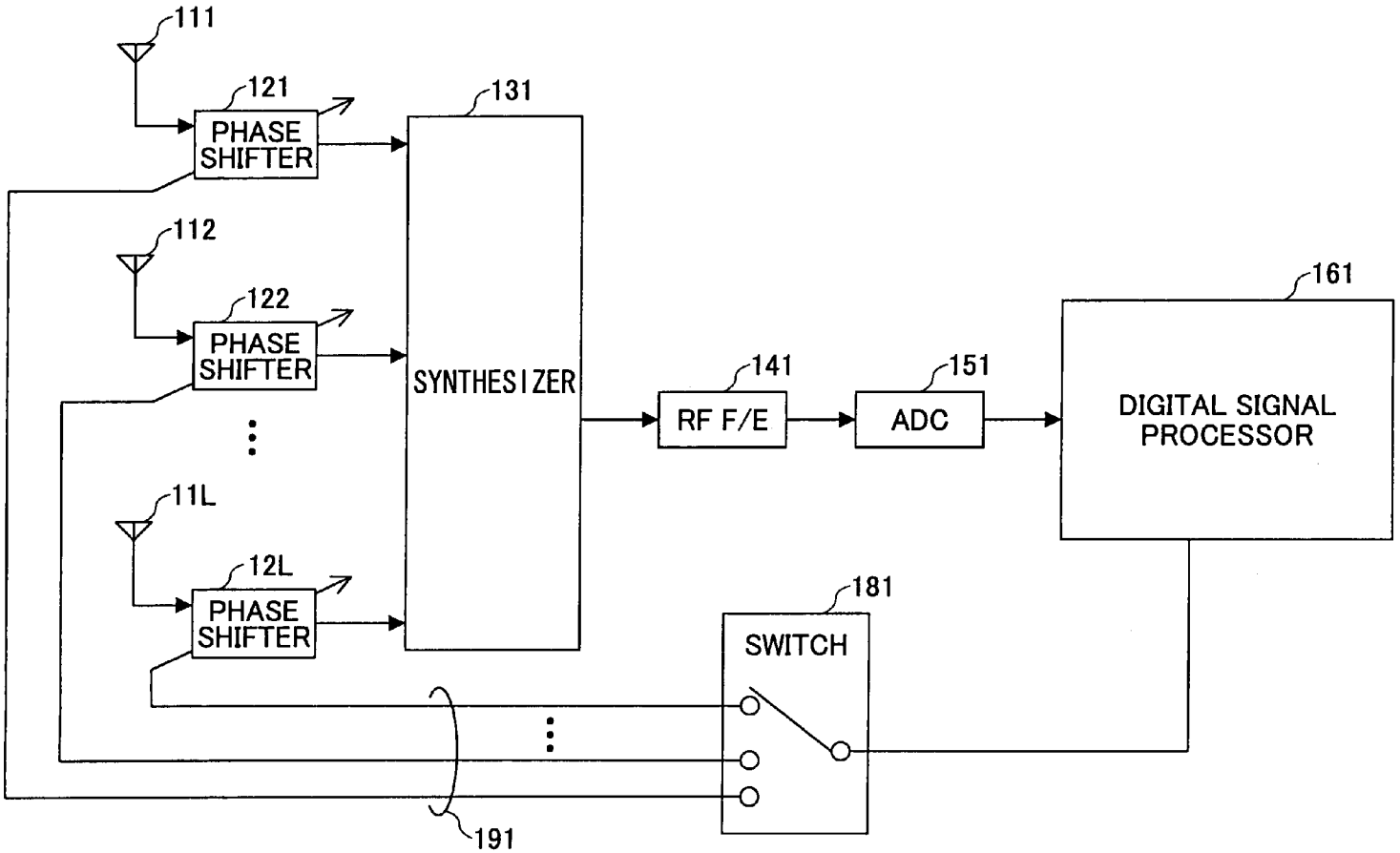
FIG. 11 is a block diagram of an adaptive array antenna system according to the sixth embodiment of the invention.

FIG. 11 is a block diagram of an adaptive array antenna system according to the sixth embodiment of the invention. The adaptive array antenna system shown in FIG. 11 has the same structure as that shown in the first embodiment, except for a switch 181 inserted between the digital signal processor 161 and the phase shifters 121–12L. The terminals of the switch 181 are successively switched to connect the digital signal processor 161 to one of the phase shifters 121–12L in order to update the weighting coefficient (or the phase) of the associated phase shifter. This arrangement can reduce the number of signal lines extending from the digital signal processor 161. In addition, even if the digital control signal output from the digital signal processor 161 has to be converted into an analog signal, only a single DAC is added. The arrangement of this embodiment is advantageous from the viewpoint of reducing the size and power consumption of the system.

Although the present invention has been described using specific examples, it is apparent for those skilled in the art that there are many modifications and substitutions that can be made without departing from the scope of the invention.

The present patent application is based on Japanese Priority Application No. 2004-048126 filed Feb. 24, 2004, the entire contents of which are hereby incorporated by reference.

What is claimed is:

1. An array antenna system comprising:

an array antenna unit including a plurality of antenna elements and a plurality of phase shifters, each phase shifter being provided to one of the antenna elements to set a weighting coefficient for the associated antenna element; and a weight controller configured to generate and output a control signal for adjusting the weighting coefficient for each of the antenna elements, using a known signal received at each of the antenna elements and subjected to weighting and signal synthesis, the weight controller having a channel impulse response estimation unit configured to estimate a channel impulse response for each of the antenna elements based on a linear combination of a first received signal obtained from the known signal when a first set of weighting coefficients is set for the antenna elements and a second received signal obtained from the known signal when a second set of weighting coefficients is set for the antenna elements; and an output unit configured to output the control signal based on the estimated channel impulse response.

2. A weight controller for controlling a weighting coefficient for each of a plurality of antenna elements of an antenna array, the weight controller comprising:

a channel impulse response estimation unit configured to estimate a channel impulse response for each of the antenna elements based on a linear combination of a first received signal acquired when a first set of weighting coefficients is set for the antenna elements and a second received signal acquired when a second set of weighting coefficients is set for the antenna elements; and an output unit configured to output a control signal for adjusting the weighting coefficient of each of the antenna elements based on the estimated channel impulse responses.

3. The weight controller of claim 2, wherein the first set of weighting coefficients gives a first phase to all of the antenna elements, and the second set of weighting coefficients gives a second phase to all of the antenna elements but for a target antenna element, while giving a third phase to the target antenna element.

4. The weight controller of claim 2, wherein a phase defined by at least one of the first and second sets of weighting coefficients is an integral multiple of .pi./2.

5. The weight controller of claim 2, wherein the control signal adjusts an amplitude and a phase of each of the antenna elements.

6. The weight controller of claim 2, wherein the first and second received signals are produced from a known signal received intermittently at the antenna elements and subjected to weighting and signal synthesis.

7. The weight controller of claim 6, wherein the known signal is inserted in at least a portion of a payload.

8. The weight controller of claim 6, wherein the known signal is received at each of the antenna elements via a dedicated channel.

9. The weight controller of claim 2, further comprising:

a weight estimation unit configured to estimate the weighting coefficient for each of the antenna elements based on the channel impulse responses.

10. The weight controller of claim 9, wherein if a phase shifter provided to each of the antenna elements is digitally formatted, the weight estimation unit selects a discrete value of the weighting coefficient for the digital phase shifter such that the selected weighting coefficient is closest to the estimated weighting coefficient.

11. The weight controller of claim 2, further comprising:

a monitoring unit configured to estimate variation in a communication channel.

12. The weight controller of claim 6, wherein the known signal consists of a plurality of symbols, and the channel impulse response estimation unit calculates the channel impulse response for each of the symbols, and averages the calculation result.

13. A weight controller for controlling a weighting coefficient for each of a plurality of antenna elements, comprising:

channel impulse response estimation unit configured to estimate a channel impulse response for each of the antenna elements based on a linear combination of a first signal, which is obtained as a vector product of a first known signal and a first received signal weighted by a first set of weighting coefficients and subjected to signal synthesis, and a second signal, which is obtained as a vector product of a second known signal orthogonal to the first known signal and a second received signal weighted by a second set of weighting coefficient and subjected to signal synthesis; and an output unit configured to generate and output a control signal for adjusting the weighting coefficient of each of the antenna elements based on the estimated channel impulse responses.

14. A method for controlling a weighting coefficient for each of a plurality of antenna elements of an antenna array, comprising:

setting a first set of weighting coefficients for the antenna elements;

receiving a known signal at each of the antenna elements to produce a first signal from the known signal through weighting and signal synthesis;

setting a second set of weighting coefficients for the antenna elements;

receiving the known signal at a different time at each of the antenna elements to produce a second signal from the known signal through weighting and signal synthesis;

estimating a channel impulse response for each of the antenna elements based on a linear combination of the first signal and the second signal; and generating and outputting a control signal for determining the weighting coefficient of each of the antenna elements based on the estimated channel impulse responses.

* * * * *